US008985963B2

(12) United States Patent
Terazawa et al.

(10) Patent No.: US 8,985,963 B2
(45) Date of Patent: Mar. 24, 2015

(54) STOP MECHANISM FOR VANE COMPRESSOR

(75) Inventors: Junichirou Terazawa, Sano (JP); Hirotada Shimaguchi, Kuki (JP)

(73) Assignee: Calsonic Kansei Corporation, Saitama (JP)

( * ) Notice: Subject to any disclaimer, the term of this patent is extended or adjusted under 35 U.S.C. 154(b) by 267 days.

(21) Appl. No.: 13/516,896

(22) PCT Filed: Dec. 14, 2010

(86) PCT No.: PCT/JP2010/072487
§ 371 (c)(1),
(2), (4) Date: Jun. 18, 2012

(87) PCT Pub. No.: WO2011/078016
PCT Pub. Date: Jun. 30, 2011

(65) Prior Publication Data

US 2012/0269670 A1 Oct. 25, 2012

(30) Foreign Application Priority Data

Dec. 24, 2009 (JP) ..... 2009-292303

(51) Int. Cl.
*F04C 2/00* (2006.01)
*F04C 18/00* (2006.01)
(Continued)

(52) U.S. Cl.
CPC ..... *F04C 18/3446* (2013.01); *F01C 21/0863* (2013.01); *F04C 28/06* (2013.01); *F04C 29/005* (2013.01); *F04C 2240/20* (2013.01)
USPC ..... 417/15; 417/44.1; 417/223; 417/410.3; 418/24; 418/268

(58) Field of Classification Search
CPC ..... F04B 49/00; F04C 14/06; F04C 18/3446; F04C 28/06
USPC ..... 417/410.3, 15, 44.1, 214, 223, 18, 212, 417/316; 310/49.55; 418/23, 24, 76, 259, 418/267, 268
See application file for complete search history.

(56) References Cited

U.S. PATENT DOCUMENTS 4,132,512 A 1/1979 Roberts
4,492,540 A 1/1985 Yamamoto
(Continued)

FOREIGN PATENT DOCUMENTS

CN 101338749 A 1/2009
CN 101363438 A 2/2009
(Continued)

*Primary Examiner* — Peter J Bertheaud
(74) *Attorney, Agent, or Firm* — Foley & Lardner LLP

(57) ABSTRACT

A vane compressor includes a cylinder block, a cylinder chamber having an ellipsoidal inner wall, a rotor whose outer circumferential surface is provided with vane slots formed thereon, a drive source for the rotor, and vanes housed in the vane slots, respectively. The rotor is rotated by the drive source while the vanes are protruded from the vane slots by backpressure generated in backpressure spaces in the vane slots to contact end edges of the vanes with the inner wall of the cylinder chamber. The compressor further comprises a stop mechanism that makes the rotor stopped at a predetermined rotational position where a difference between a total volume of the backpressure spaces when operated and a total volume of the backpressure spaces when stopped becomes minimum. According to the compressor, chattering can be prevented without extra workings on the vanes or the rotor and without providing extra parts.

6 Claims, 6 Drawing Sheets

(51) Int. Cl.

| | |
|---|---|
| ***F04C 14/18*** | (2006.01) |
| ***F04C 28/18*** | (2006.01) |
| ***F04C 18/344*** | (2006.01) |
| ***F01C 21/08*** | (2006.01) |
| ***F04C 28/06*** | (2006.01) |
| ***F04C 29/00*** | (2006.01) |

(56) References Cited

U.S. PATENT DOCUMENTS

| | | | | |
|---|---|---|---|---|
| 4,558,265 | A * | 12/1985 | Hayashida et al. | 318/561 |
| 4,621,986 | A * | 11/1986 | Sudo | 417/304 |
| 4,936,761 | A | 6/1990 | Hasegaki et al. | |
| 6,398,506 | B1 * | 6/2002 | Maekawa et al. | 417/12 |
| 6,589,033 | B1 * | 7/2003 | Johnson et al. | 418/13 |
| 2006/0186843 | A1 * | 8/2006 | Hattori et al. | 318/254 |
| 2009/0041606 | A1 | 2/2009 | Ueshima | |
| 2009/0162234 | A1 * | 6/2009 | Shimaguchi et al. | 418/266 |

FOREIGN PATENT DOCUMENTS

| | | | |
|---|---|---|---|
| JP | 58-174193 | A | 10/1983 |
| JP | 58-220989 | A | 12/1983 |
| JP | 60-150496 | A | 8/1985 |
| JP | 03-074592 | A | 3/1991 |
| JP | 8-000538 | Y2 | 1/1996 |
| JP | 2009-121445 | A | 6/2009 |

* cited by examiner (a)

(b)

STOP MECHANISM FOR VANE COMPRESSOR

TECHNICAL FIELD

The present invention relates to a vane compressor.

BACKGROUND ART

A vane compressor includes a cylinder block in which a cylinder chamber having an ellipsoidal inner wall is formed, a rotor that is rotatably supported in the cylinder chamber and rotates by receiving a drive force, and plural vanes that are inserted in plural vane slots formed on an outer circumferential surface of the rotor, respectively. While the rotor rotates, the vanes are protruded by backpressure generated in backpressure spaces in the vane slots, so that end edges of the vanes are slidably contacted with the inner wall of the cylinder chamber and the vanes reciprocate in the vane slots.

Since the backpressure is generated by high-pressure refrigerant in the cylinder chamber in operation, the vanes are protruded from the vane slots and the end edges of the vanes are slidably contacted with the inner wall of the cylinder chamber, so that a volume of the backpressure spaces is kept almost constant.

On the other hand, pressure in the compressor becomes uniform while it is stopped, so that the backpressure to protrude the vanes doesn't act on the vanes. Therefore, a vane oriented vertically upward drops down in a vane slot while ejecting refrigerant and oil in the vane slot out through clearances between inner walls of the vane slot and the vane due to its own weight. Therefore, the volume of the backpressure spaces may gradually decrease if its stopped state continues. When the compressor is started up from this state, the volume of the backpressure spaces is small and a volume of the refrigerant and the oil flowing into the backpressure spaces through the clearances between the inner walls of the vane slot and the vane is small, so that the vane cannot protrude quickly even if a force for protruding the vane acts thereon due to a centrifugal force by the rotation of the rotor. Therefore, the backpressure spaces become negative pressure and the vane is difficult to protrude, so that the end edge of the vane is not sufficiently protruded to the inner wall surface of the cylinder chamber. As a result, the vane is repeatedly contacted-with and hit-back-from the inner wall surface of the cylinder chamber and thereby noises (chattering) may occur.

A Patent Document 1 listed below discloses a compressor that prevents chattering. In the compressor, a support plate is disposed on a bottom of a vane slot and pins are fixed on the support plate. Coil springs for biasing a vane in a protruding direction are inserted to the pins. As a result, the vane does not drop down in the vane slot in a stopped state of the compressor. When the compressor is started up, the vane is protruded from the vane slot by a biasing force of the coil springs and its end edge is slidably contacted with an inner wall of a cylinder chamber, so that chattering is prevented.

PRIOR ART DOCUMENT

Patent Document

Patent Document 1: Japanese Examined Utility Model Publication No. H8-538

SUMMARY OF INVENTION

However, in the compressor disclosed in the Patent Document 1 mentioned above, it is needed to provide the coil springs as extra parts. In addition, use of the coil springs increases assembling man-hours and thereby its costs. Further, working processes for the vanes become complicated due to the application of the coil springs.

An object of the present invention is to provide a vane compressor that can prevent chattering without extra workings on vanes or a rotor and without providing extra parts by reducing difference between a total volume of backpressure spaces while the compressor is operated and a total volume of the backpressure spaces while the compressor is stopped.

An aspect of the present invention provides a vane compressor that includes a cylinder block, a cylinder chamber that is formed in an inside of the cylinder block and has an ellipsoidal inner wall, a rotor that is rotatably supported in the cylinder chamber and whose outer circumferential surface is provided with a plurality of vane slots formed thereon, a drive source for rotating the rotor, and a plurality of vanes that is housed in the plurality of vane slots, respectively, wherein the rotor is rotated by the drive source while the vanes are protruded from the vane slots by backpressure generated in backpressure spaces in the vane slots to contact end edges of the vanes with the inner wall of the cylinder chamber, and the compressor further comprises a stop mechanism that makes the rotor stopped at a predetermined rotational position where a difference between a total volume of the backpressure spaces when operated and a total volume of the backpressure spaces when stopped becomes minimum.

According to the aspect, the rotor can be stopped at the predetermined rotational position where the difference between the total volume of the backpressure spaces when the compressor is operated and the total volume of the backpressure spaces when the compressor is stopped becomes minimum. As a result, chattering can be prevented without extra workings on the vane slots, the vanes or the rotor and without providing extra parts.

Here, it is preferable that the drive source is an electrical motor for rotationally driving the rotor while detecting a rotational position of the rotor, and the stop mechanism is a drive circuit for controlling the electrical motor so as to make the rotor stopped at the predetermined rotational position.

Alternatively, it is preferable that the stop mechanism is constituted of a clutch disposed between the rotor and the drive source, a plurality of rotor-side magnets mounted in the rotor along a circumferential direction at even intervals, and a plurality of cylinder-side magnets mounted in the inner wall of the cylinder chamber, and the stop mechanism disengages the clutch to make the rotor stopped at the predetermined rotational position due to a repulsive force and an attractive force acting between the rotor-side magnets and the cylinder-side magnets.

In addition, it is preferable that the compressor is arranged, when installed on a vehicle, such that an ellipsoidal major axis direction of the cylinder chamber is oriented in a horizontal direction. According to this, the difference between the total volume of the backpressure spaces when the compressor is operated and the total volume of the backpressure spaces when stopped becomes smaller.

DESCRIPTION OF EMBODIMENTS

Hereinafter, embodiments of a vane compressor will be explained with reference to the drawings.

First Embodiment

Figure 1:
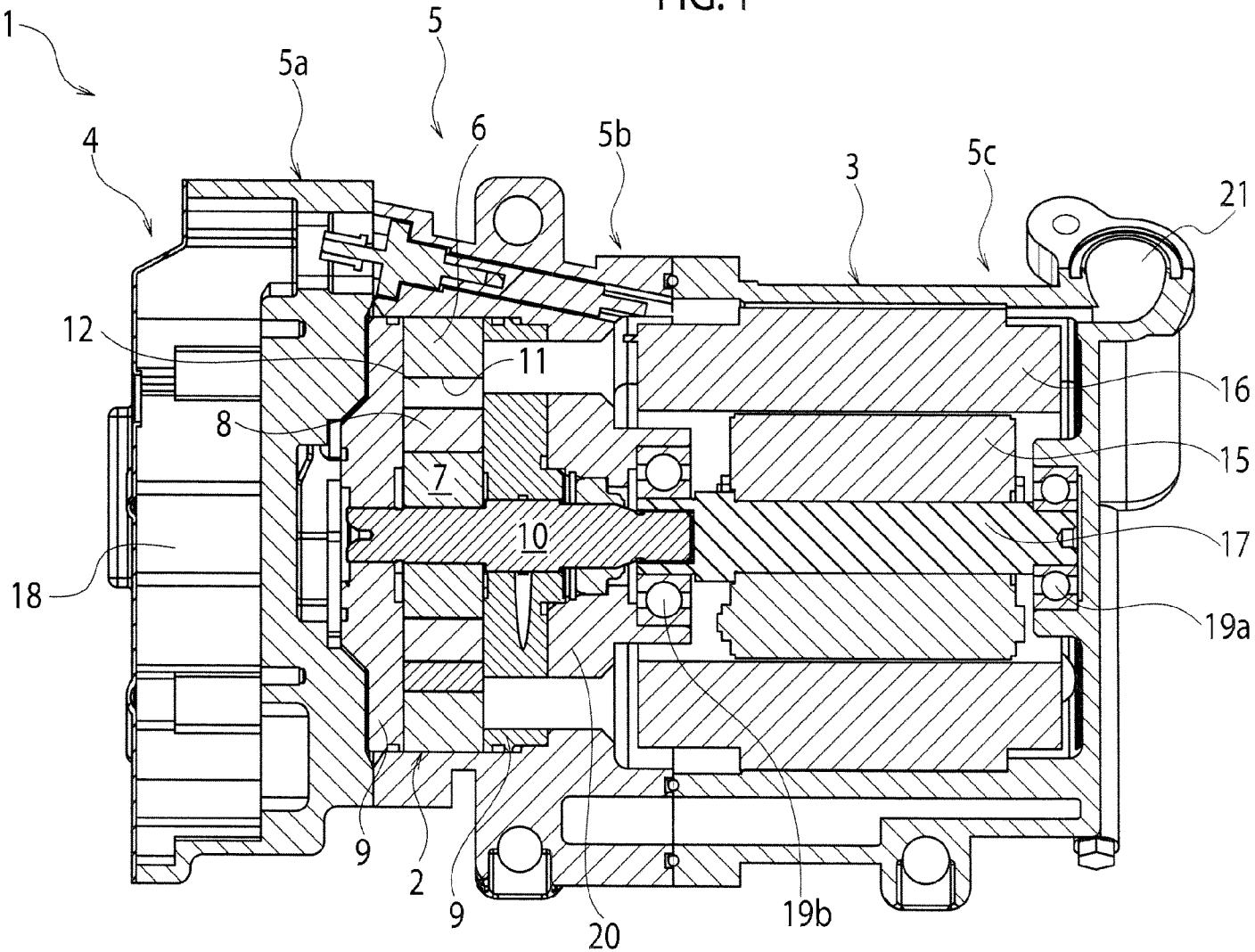
FIG. 1 is an overall cross-sectional view of a vane compressor 1 according to a first embodiment.

As shown in FIG. 1, a vane compressor 1 according to a first embodiment includes, a cylinder block 6, a rotor 7, and plural vanes 8. A cylinder chamber 12 having an ellipsoidal inner wall is formed in the cylinder block 6. The rotor 7 is rotatably supported in the cylinder chamber 12 and rotated by a drive force from a motor (a drive source) 3. The vanes 8 are inserted in plural vane slots 13 formed on an outer circumferential surface of the rotor 7, respectively. When the rotor 7 rotates, the vanes 8 are protruded by backpressure generated in backpressure spaces 14 in the vane slots 13, so that end edges of the vanes 8 are slidably contacted with the inner wall of the cylinder chamber 12 and the vanes 8 reciprocate in the vane slots 13. The compressor 1 according to the present embodiment is provided with a stop mechanism for stopping the rotor 7 at a rotational position where difference between a total volume of the backpressure spaces 14 when operated and a total volume of the backpressure spaces 14 when stopped becomes small. Especially in the embodiments explained hereinafter, the rotor 7 is made stopped at a rotational position where the above difference become minimum. The backpressure space(s) 14 will be explained in detail later.

Further, in the present embodiment, the motor (the electrical motor) 3 functions as the drive source for rotationally driving the rotor 7 while detecting its rotational position, and a drive circuit 18 for stopping the rotor 7 at the rotational position where the difference between the total volume of the backpressure spaces 14 when the compressor 1 is operated and the total volume of the backpressure spaces 14 when stopped becomes small functions as the stop mechanism.

Hereinafter, the compressor 1 will be explained in detail.

As shown in FIG. 1, in the compressor 1, a compression section 2, the motor (the drive source: the electrical motor) 3, and an inverter 4 are housed in a cylindrical case 5. The case 5 is constituted of a front case 5*a* that houses the inverter 4, a middle case 5*b* that houses the compression section 2, and a rear case 5*c* that houses the motor 3. The front case 5*a*, the middle case 5*b* and the rear case 5*c* are engaged with each other by bolts or the like, and a sealed chamber is formed in an inside of the case 5.

The compression section 2 in the middle case 5*b* includes the cylindrical cylinder block 6, a pair of side blocks 9 provided at both sides of the cylinder block 6, and the columnar rotor 7. The cylinder chamber 12 that has a smooth ellipsoidal inner wall surface 11 is formed in an inside of the cylinder block 6. Both sides of the cylinder chamber 12 are closed by the pair of side blocks 9. The rotor 7 is disposed at a center of the cylinder chamber 12. In addition, a rotary shaft 10 coupled with a rotor shaft 17 of the motor 3 penetrates through the cylinder chamber 12. The rotor 7 is supported by the rotary shaft 10, and rotated in the cylinder chamber 12 by the rotational drive force of the rotor 7 via the rotary shaft 10.

Figure 2:
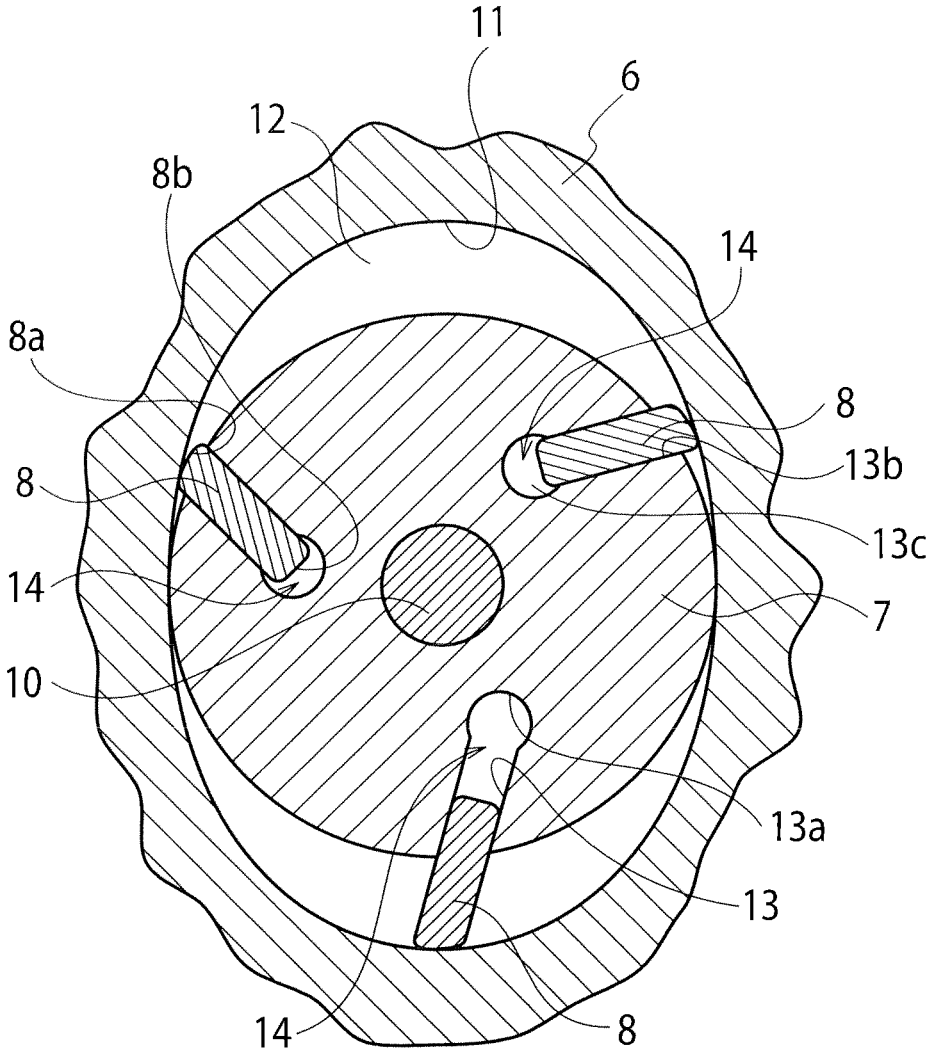
FIG. 2 is an enlarged cross-sectional view of a cylinder block 6 in the first embodiment.

As shown in FIG. 2, the three vane slots 13 are formed on the outer circumferential surface of the rotor 7 along its circumferential direction at even intervals. The vane slots 13 are formed from the outer circumferential surface toward innards of the rotor 7. The vane slot(s) 13 is constituted of a vane movable portion 13*b* that houses the planar vane 8 reciprocatably, and a pressure introduction portion 13*c* that has a circular cross-sectional shape and communicated with the vane movable portion 13*b*. The pressure introduction portion 13*c* communicates with refrigerant paths in the side blocks 9. The vane movable portion 13*b* and the pressure introduction portion 13*c* are formed along the rotary shaft 10 of the rotor 7. In addition, the backpressure space 14 to which oil is supplied together with refrigerant is formed between a bottom 13*a* of the vane slot 13 and a rear edge Bb of the vane 8. A volume of the backpressure space 14 varies along with a reciprocation of the vane 8.

The vane(s) 8 is protruded from the vane slot 13 by an centrifugal force due to the rotation of the rotor 7 and a pressure of the oil and refrigerant supplied to the vane movable portion 13*b* and the pressure introduction portion 13*c* (i.e. the backpressure space 14). The vane 8 reciprocates in the vane slot 13 with its end edge 8*a* slidably contacted with the inner wall surface 11 of the cylinder chamber 12. When the rotor 7 is rotated by the rotational drive force of the motor 3, the refrigerant is compressed due to volume changes of compression chambers segmented by the inner wall surface 11 of the cylinder chamber 12 and the vanes 8.

The motor 3 is an electrical motor, and, as shown in FIG. 1, constituted of plural coils 16 aligned along an internal circumferential surface of the rear case 5*c*, a motor rotor 15 to be rotated by magnetism generated by the coils 16, and the rotor shaft 17 fixed at a center of the motor rotor 15. The rotor shaft 17 rotates along with the motor rotor 15. Both ends of the rotor shaft 17 are rotatably supported by the rear case 5*c* and a partition wall arranged between the motor 3 and the side block 9 via bearings 19*a* and 19*b*.

In addition, the motor 3 in the present embodiment is a so-called sensored electrical motor that can detect a rotational angle of the motor rotor 15. The rotational angle of the motor rotor 15 is detected by a sensor not shown, and its detection result is transmitted to the drive circuit 18. Note that, for example, the sensor detects the rotational angle of the motor rotor 15 by detecting a position of a magnet mounted in the motor rotor 15.

In addition, the rotor shaft 17 coupled with the rotary shaft 10 is made stopped at a predetermined rotational angle in order to stop the rotor 7 at the predetermined rotational position (i.e. rotational position where the total volume of the backpressure spaces 14 when the compressor 1 is operated and the total volume of the backpressure spaces 14 when stopped becomes small). Therefore, the drive circuit 18 controls the rotor shaft 17 so as to stop it at the predetermined rotational angle based on the detection result of the rotational angle of the motor rotor 15.

The inverter 4 is configured of a drive circuit housed in the front case 5*a*, and controls power supply to the coils 16 based on the detection result of the rotational angle of the motor rotor 15

Next, volume fluctuations of the backpressure spaces 14 when the compressor 1 is operated and stopped will be explained with reference to FIG. 3.

Figure 3:
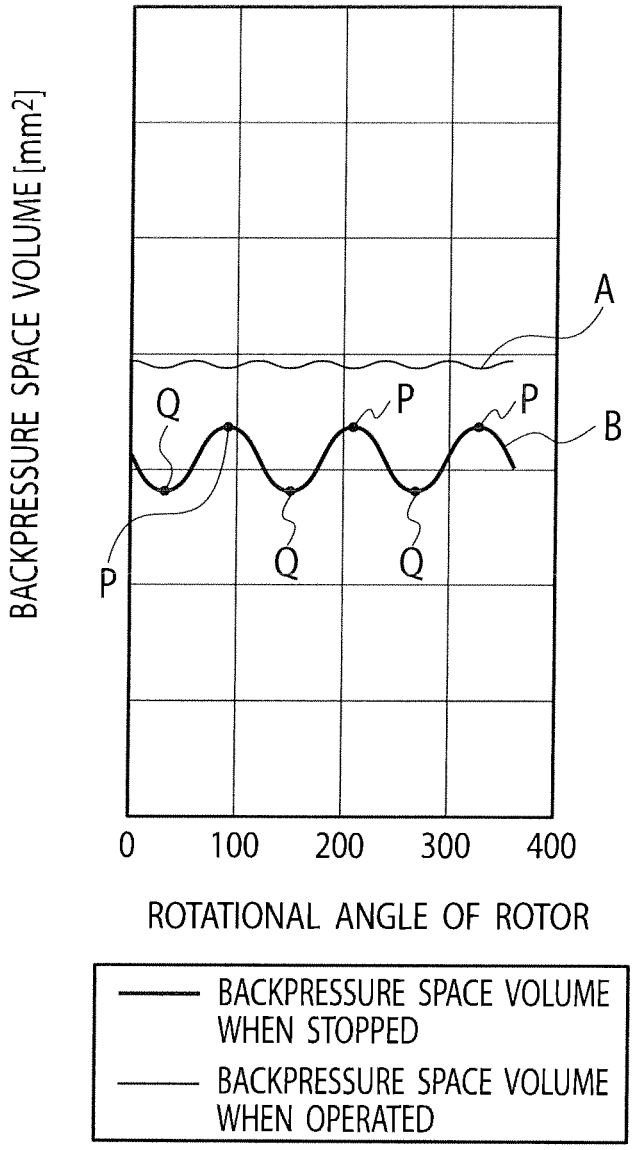
FIG. 3 is a graph showing relationship between a rotor rotational angle and a volume fluctuation of backpressure spaces 14 when the compressor in the first embodiment is operated and stopped.

A graph in FIG. 3 shows the fluctuations of the total volume of the backpressure spaces 14 in a case of the compression section 2 (see FIG. 2) with the tree vanes 8 in the first embodiment. Its horizontal axis indicates the rotational angle of the rotor 7, and its vertical axis indicates the total volume of the backpressure spaces 14 (the total volume of the three backpressure spaces 14).

A curved line A indicates the fluctuation of the total volume of the backpressure spaces 14 when the compressor 1 is operated, and a curved line B indicates the fluctuation of the total volume of the backpressure spaces 14 when stopped. In an operated state shown by the curved line A, since all the end edges 8*a* of the vanes 8 contact with the inner wall surface 11 of the cylinder chamber 12, the fluctuation of the total volume of the backpressure spaces 14 relative to the rotational angle of the rotor 7 is small and keeps an almost constant value.

On the other hand, a stopped state shown by the curved line B, the fluctuation of the total volume of the backpressure spaces 14 relative to the rotational angle of the rotor 7 varies significantly. Since one of the vanes 8 is oriented vertically upward when the rotor 7 is made stopped at a rotational angle (about 40°, about 150°, about 260° . . . ) indicated by points Q on the curved line B, the very vane 8 drops down in the vane slot 13 due to its own weight. As a result, the volume of the backpressure space 14 of the vane 8 oriented vertically upward decreases, so that the total volume of the backpressure spaces 14 becomes small (the difference relative to the total volume when operated is large [become maximum]). Alternatively, at a rotational angle (about 90°, about 210°, about 320° . . . ) indicated by points P on the curved line B, the rotor 7 stops at a position where a drop-down distance of the vane(s) 8 due to its own weight is small (see FIG. 2). Therefore, the total volume of the backpressure spaces 14 becomes large (the difference relative to the total volume when operated is small [become minimum]).

From these curved lines A and B, it turns out that the total volume of the backpressure spaces 14 varies significantly according to the rotational angle (the rotational position) of the rotor 7 when the compressor 1 is stopped. Decrease of the total volume of the backpressure spaces 14 can be restricted by setting a stop position of the rotor 7 with the compressor 1 stopped to the predetermined rotational angel.

Therefore, in the present embodiment, the drive circuit 18 controls the rotational angle of the motor 3 so as to stop the rotor 7 at the rotational angle where the difference between the total volume of the backpressure spaces 14 indicated by the curved line A and the total volume of the backpressure spaces 14 indicated by the curved line B becomes small.

Next, the operation of the compressor 1 according to the present embodiment will be explained.

In the compressor 1, electrical current is supplied to the coils 16 of the motor 3 from the drive circuit, so that the rotor shaft 17 is rotated together with the motor rotor 15. When the rotor shaft 17 is rotated, the rotor 7 is rotated via the rotary shaft 10 coupled with an end of the rotor shaft 17, and thereby refrigerant is compressed. The compressed refrigerant flows through the inside of the middle case 5*b* and the motor 3 in the rear case 5*c*, and is discharged to an outside from a discharge port 21.

When the compressor 1 is to be stopped, the drive circuit 18 stops the rotor 7 at the above-described predetermined rotational position (the rotational position where the difference between the total volume of the backpressure spaces 14 when operated of the compressor 1 and the total volume of the backpressure spaces 14 when stopped becomes small) by controlling the motor 3. Namely, as shown in FIG. 2, the rotor 7 is made stopped at the rotational position where the drop-down distance of the vane(s) 8 due to its own weight is small.

As explained above, by stopping the rotor 7 at the position where the drop-down distance of the vane(s) 8 due to its own weight is small, the difference between the total volume of the backpressure spaces 14 when operated and the total volume of the backpressure spaces 14 when stopped can be made small without extra workings on the vane slots 13, the vanes 8 or the rotor 7 and without providing extra parts. As a result, chattering upon starting-up can be prevented.

Note that, the motor 3 is a sensored electrical motor in the present embodiment, but it may be a sensorless motor. In a case of a sensorless motor, the rotor shaft 17 and the rotary shaft 10 are coupled with each other with a predetermined coupling angle (i.e. a rotational positional relation between the motor rotor 15 and the rotor 7 is fixed), the rotational angle of the rotor 7 is estimated based on electrical current flowing through the motor rotor 15. It can be done to stop the rotor 7 at the above-described predetermined rotational position based on the estimated result. Note that the rotation of the motor rotor 15 is controlled by the drive circuit 18 also in this case.

In addition, the compressor 1 in the present embodiment is installed on a vehicle, and arranged, when installed on the vehicle, such that an ellipsoidal major axis direction of the cylinder chamber 12 perpendicularly intersects a horizontal direction (such that the ellipsoidal major axis direction extends along a vertical direction) as shown FIG. 2.

Second Embodiment

Next, a vane compressor according to a second embodiment will be explained with reference to FIG. 4(*a*) and FIG. 5(*a*). Note that redundant explanations for identical and similar components to those in the above-explained first embodiment will be omitted by adding identical reference numerals.

Figure 4:
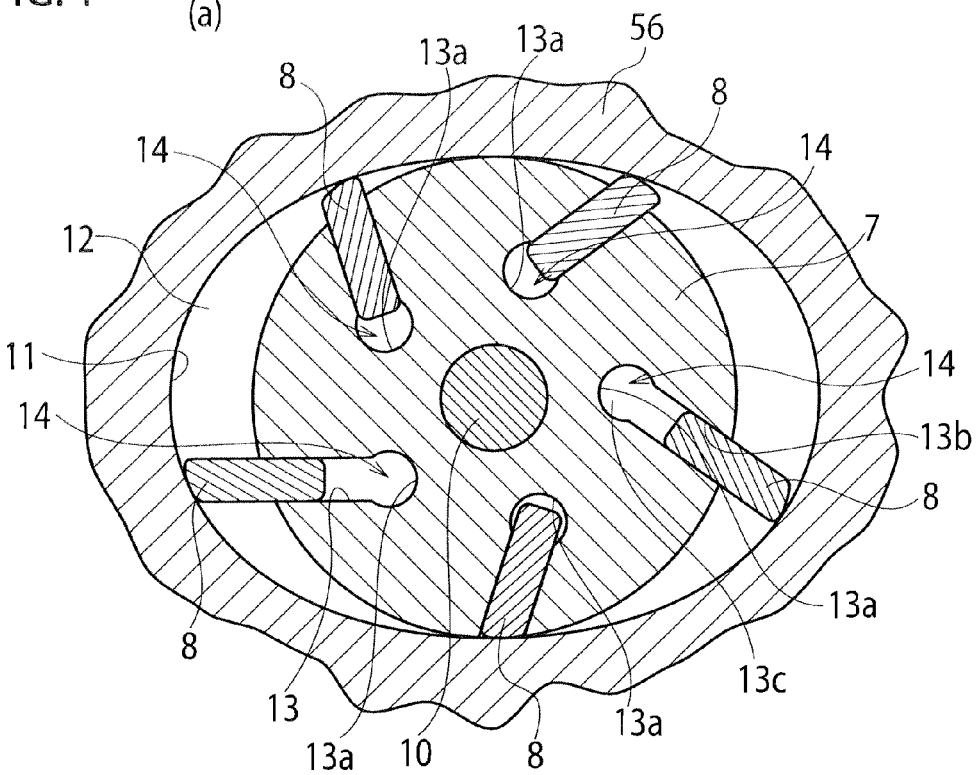
FIG. 4 (*a*) is an enlarged cross-sectional view of a cylinder block 6 in a second embodiment, and (*b*) is an enlarged cross-sectional view of a cylinder block 6 in a third embodiment.
Figure 4:
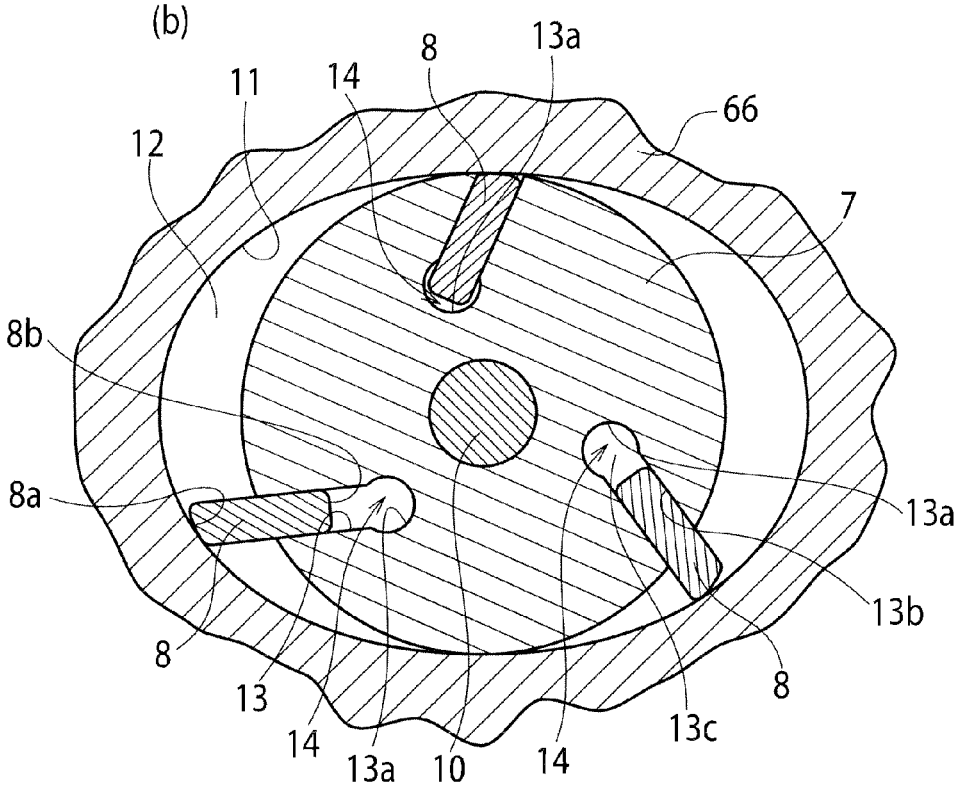

As shown in FIG. 4(*a*), five vanes 8 are provided in a cylinder block 56 of the compression section 2. When the compressor is installed on a vehicle, it is arranged such that the ellipsoidal major axis direction of the cylinder chamber 12 perpendicularly intersects a vertical direction (such that the ellipsoidal major axis direction extends along a horizontal direction).

Similarly to the first embodiment, the drive circuit 18 stops the rotor 7 at the above-described predetermined rotational position (the rotational position where the difference between the total volume of the backpressure spaces 14 when the compressor 1 is operated and the total volume of the backpressure spaces 14 when stopped becomes small) by controlling the motor 3 based on the detection result of the rotational angle of the motor rotor 15.

Figure 5:
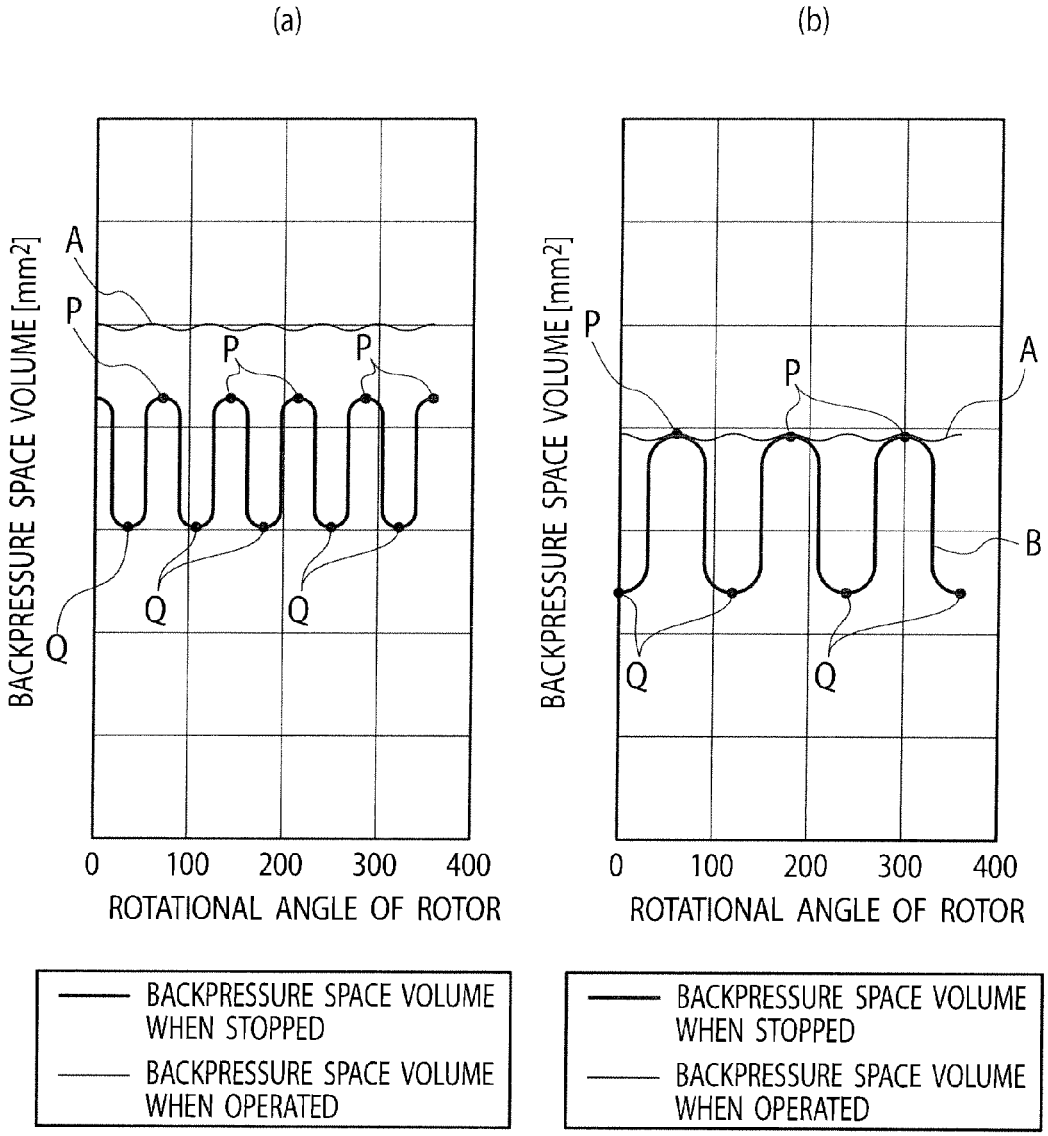
FIG. 5 (*a*) is a graph showing relationship between a rotor rotational angle and a volume fluctuation of backpressure spaces 14 when the compressor in the second embodiment is operated and stopped, and (*b*) is a graph showing relationship between a rotor rotational angle and a volume fluctuation of backpressure spaces 14 when the compressor in the third embodiment is operated and stopped.

A graph in FIG. 5(*a*) shows fluctuations of the total volume of the backpressure spaces 14 in a case of the compression section 2 (see FIG. 4(*a*)) with the five vanes 8 in the second embodiment. Similarly to the graph in FIG. 3, its horizontal axis indicates the rotational angle of the rotor 7, and its vertical axis indicates the total volume of the backpressure spaces 14 (the total volume of the five backpressure spaces 14).

Points Q on the curved line B indicate the rotational angles of the rotor 7 where the total volume of the backpressure spaces 14 when the compressor 1 is stopped becomes small (the difference relative to the total volume when operated is large [become maximum]). Points P indicate the rotational angles of the rotor 7 where the total volume of the backpressure spaces 14 when operated of the compressor 1 becomes large (the difference relative to the total volume when operated is small [become minimum]).

Therefore, by stopping the rotor 7 at the position where the difference between the total volume of the backpressure spaces 14 when the compressor 1 is operated and the total volume of the backpressure spaces 14 when stopped, chattering upon starting-up can be prevented. In the present embodiment, since the ellipsoidal major axis direction of the cylinder chamber 12 is arranged so as to intersect a vertical direction perpendicularly (the ellipsoidal major axis direction is arranged so as to extend along a horizontal direction), such a predetermined rotational position of the rotor 7 is a rotational position where a drop-down distance of the vane(s) 8 due to its own weight is small as shown in FIG. 4(*a*).

In addition, since the rotor 7 is only controlled by the drive circuit 18 so as to stop at the above-described rotational angle, the difference between the total volume of the backpressure spaces 14 when operated and the total volume of the backpressure spaces 14 when stopped can be made small without extra workings on the vane slots 13, the vanes 8 or the rotor 7 and without providing extra parts. As a result, chattering upon starting-up can be prevented.

Third Embodiment

Next, a vane compressor according to a third embodiment will be explained with reference to FIG. 4(*b*) and FIG. 5(*b*). Note that redundant explanations for identical and similar components to those in the above-explained first embodiment will be omitted by adding identical reference numerals.

As shown in FIG. 4(*b*), three vanes 8 are provided in a cylinder block 66 of the compression section 2. When the compressor is installed on a vehicle, it is arranged such that the ellipsoidal major axis direction of the cylinder chamber 12 perpendicularly intersects a vertical direction (such that the ellipsoidal major axis direction extends along a horizontal direction).

Similarly to the first embodiment, the drive circuit 18 stops the rotor 7 at the above-described predetermined rotational position (the rotational position where the difference between the total volume of the backpressure spaces 14 when the compressor 1 is operated and the total volume of the backpressure spaces 14 when stopped becomes small) by controlling the motor 3 based on the detection result of the rotational angle of the motor rotor 15.

A graph in FIG. 5(*b*) shows fluctuations of the total volume of the backpressure spaces 14 in a case of the compression section 2 (see FIG. 4(*b*)) with the three vanes 8 in the third embodiment. Similarly to the graph in FIG. 3, its horizontal axis indicates the rotational angle of the rotor 7, and its vertical axis indicates the total volume of the backpressure spaces 14 (the total volume of the three backpressure spaces 14).

Points Q on the curved line B indicate the rotational angles of the rotor 7 where the total volume of the backpressure spaces 14 when the compressor 1 is stopped becomes small (the difference relative to the total volume when operated is large [become maximum]). Points P indicate the rotational angles of the rotor 7 where the total volume of the backpressure spaces 14 the compressor 1 is operated becomes large (the difference relative to the total volume when operated is small [become minimum]). In the present embodiment, at the rotational angles of the rotor 7 indicated by the points P, there is no difference between the total volume of the backpressure spaces 14 when the compressor 1 is operated and the total volume of the backpressure spaces 14 when stopped. Namely, at the rotational positions of the rotor 7 indicated by the points P, there is no difference in the total volume of the backpressure spaces 14 when the compressor 1 is operated and stopped.

Therefore, by stopping the rotor 7 at the position where the difference between the total volume of the backpressure spaces 14 when the compressor 1 is operated and the total volume of the backpressure spaces 14 when stopped, chattering upon starting-up can be prevented. In the present embodiment, since the ellipsoidal major axis direction of the cylinder chamber 12 is arranged so as to intersect a vertical direction perpendicularly (the ellipsoidal major axis direction is arranged so as to extend along a horizontal direction), such a predetermined rotational position of the rotor 7 is a rotational position where a drop-down distance of the vane(s) 8 due to its own weight is small as shown in FIG. 4(*b*).

In addition, since the rotor 7 is only controlled by the drive circuit 18 so as to stop at the above-described rotational angle, the difference between the total volume of the backpressure spaces 14 when operated and the total volume of the backpressure spaces 14 when stopped can be made small without extra workings on the vane slots 13, the vanes 8 or the rotor 7 and without providing extra parts. As a result, chattering upon starting-up can be prevented.

Fourth Embodiment

Figure 6:
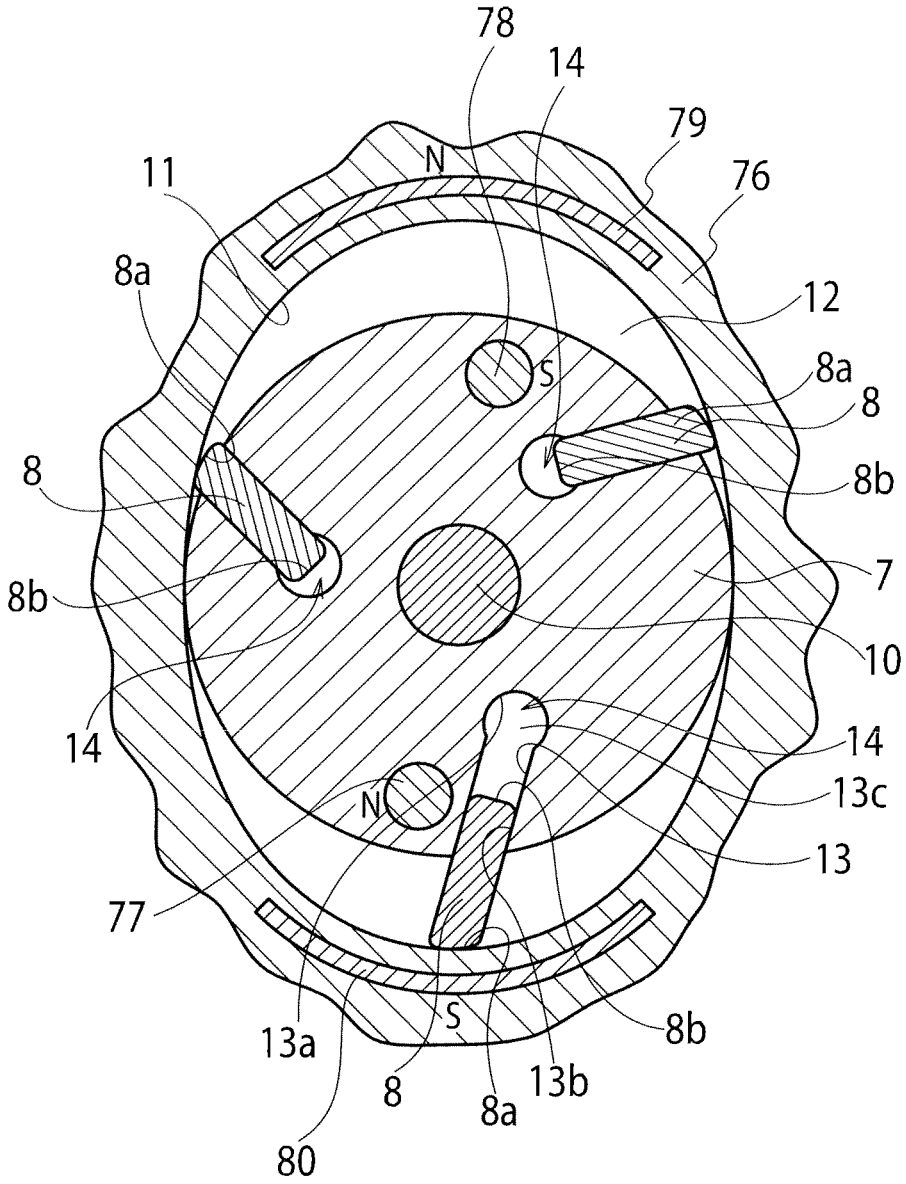
FIG. 6 is an enlarged cross-sectional view of a cylinder block 6 in a fourth embodiment.

Next, a vane compressor according to a fourth embodiment will be explained with reference to FIG. 6. Note that redundant explanations for identical and similar components to those in the above-explained first embodiment will be omitted by adding identical reference numerals.

In the present embodiment, the rotor 7 in the cylinder chamber 12 of a cylinder block 76 is coupled with an internal engine (a drive source) via a clutch. The clutch is provided at a position of a member 20 shown in FIG. 1, for example, and a pulley or the like for receiving a drive force from the engine is attached thereto in stead of the motor 3 shown in FIG. 1.

A stop mechanism is constituted of N and S polar rotor-side magnets 77 and 78 mounted in the rotor 7 along its circumferential direction at even intervals, and N and S polar cylinder-side magnets 79 and 80 mounted in an inner wall of the cylinder chamber 12. When the clutch is disengaged upon stopping the compressor, the rotor 7 is disengaged with the engine and the rotor 7 is made stopped at the above-described predetermined rotational position (the rotational position where the difference between the total volume of the backpressure spaces 14 when the compressor is operated and the total volume of the backpressure spaces 14 when stopped becomes small) due to a repulsive force and an attractive force acting between the rotor-side magnets 77 and 78 and the cylinder-side magnets 79 and 80.

According to the present embodiment, a rotational drive force by the engine (the drive source) for the rotor 7 is transmitted to the rotor 7 via the clutch. When the compressor is stopped, the rotor 7 is made stopped at the above-described predetermined rotational position by the rotor-side magnets 77 and 78 and the cylinder-side magnets 79 and 80. Therefore, since the difference between the total volume of the backpressure spaces 14 when operated and the total volume of the backpressure spaces 14 when stopped can be made small, chattering can be prevented.

In addition, the difference between the total volume of the backpressure spaces 14 when operated and the total volume of the backpressure spaces 14 when stopped can be made small without extra workings on the vane slots 13, the vanes 8 or the rotor 7 and without providing extra parts, other than embedding the magnets 77 to 80 in the rotor 7 and the inner wall of the cylinder chamber 12. As a result, chattering upon starting-up can be prevented.

Note that the present invention is appropriate for a horizontal vane compressor (in which an ellipsoidal major axis direction of a cylinder chamber 12 is extended along a horizontal direction) because a drop-off distance of an upwardly oriented vane(s) 8 due to its own weight can be made smaller in relation to a shape of the cylinder chamber 12.

The invention claimed is:

1. A vane compressor comprising:

a cylinder block;

a cylinder chamber that is formed in an inside of the cylinder block and that has an ellipsoidal inner wall;

a rotor that is rotatably supported in the cylinder chamber and having an outer circumferential surface provided with a plurality of vane slots formed thereon;

a drive source for rotating the rotor; and a plurality of vanes housed in the plurality of vane slots, respectively, wherein the rotor is rotated by the drive source while the vanes are protruded from the vane slots by backpressure generated in backpressure spaces in the vane slots to contact end edges of the vanes with the inner wall of the cylinder chamber, the compressor further comprises a stop mechanism that stops the rotor at a predetermined rotational position where a difference between a total volume of the backpressure spaces when operated and a total volume of the backpressure spaces when stopped becomes a minimum;

wherein the drive source is an electrical motor provided with a sensor configured to detect a rotational angle thereof, the electrical motor is configured to rotationally drive the rotor, the electrical motor detecting a rotational position of the rotor based on the rotational angle, and the stop mechanism is a drive circuit for controlling the electrical motor so as to stop the rotor at the predetermined rotational position.

2. A vane compressor comprising:

a cylinder block;

a cylinder chamber that is formed in an inside of the cylinder block and that has an ellipsoidal inner wall;

a rotor that is rotatably supported in the cylinder chamber and having an outer circumferential surface provided with a plurality of vane slots formed thereon;

a drive source for rotating the rotor; and a plurality of vanes housed in the plurality of vane slots, respectively, wherein the rotor is rotated by the drive source while the vanes are protruded from the vane slots by backpressure generated in backpressure spaces in the vane slots to contact end edges of the vanes with the inner wall of the cylinder chamber, the compressor further comprises a stop mechanism that stops the rotor at a predetermined rotational position where a difference between a total volume of the backpressure spaces when operated and a total volume of the backpressure spaces when stopped becomes a minimum;

wherein the stop mechanism comprises a clutch disposed between the rotor and the drive source, a plurality of rotor-side magnets mounted in the rotor along a circumferential direction at even intervals, and a plurality of cylinder-side magnets mounted in the inner wall of the cylinder chamber, and the stop mechanism disengages the clutch to stop the rotor at the predetermined rotational position due to a repulsive force and an attractive force acting between the rotor-side magnets and the cylinder-side magnets.

3. The vane compressor according to claim 1, wherein the compressor is arranged such that an ellipsoidal major axis direction of the cylinder chamber is oriented in a horizontal direction, and the compressor is configured to be installed in a vehicle.

4. The vane compressor according to claim 2, wherein the compressor is arranged such that an ellipsoidal major axis direction of the cylinder chamber is oriented in a horizontal direction, and the compressor is configured to be installed in a vehicle.

5. The vane compressor according to claim 1, wherein when the compressor is stopped, a vane of the plurality of the vanes which is oriented upward retracts into the vane slot in which the vane is housed due to an own weight of the vane.

6. The vane compressor according to claim 1, wherein a detected rotational angle detected by the sensor is transmitted to the drive circuit.

* * * * *